US005546863A

United States Patent [19]

Joslyn

[11] Patent Number: 5,546,863

[45] Date of Patent: Aug. 20, 1996

[54] LINE CARRYING PROJECTILE

[75] Inventor: Edward Joslyn, Pawleys Island, S.C.

[73] Assignee: O. F. Mossberg & Sons, Inc., North Haven, Conn.

[21] Appl. No.: 363,391

[22] Filed: Dec. 22, 1994

[51] Int. Cl.[6] ..... F42B 12/68

[52] U.S. Cl. ..... 102/504; 102/336; 102/483; 102/513; 42/105; 89/1.34

[58] Field of Search ..... 102/336, 341, 102/371, 483, 504, 513; 42/105; 89/1.34

[56] References Cited

U.S. PATENT DOCUMENTS

| | | | |
|---|---|---|---|
| 940,527 | 11/1909 | Hale | 102/483 |
| 1,121,091 | 12/1914 | Hale | 102/483 |
| 1,257,126 | 2/1918 | Schneider | 102/483 |
| 2,069,276 | 2/1937 | Ryan | 102/34 |
| 2,111,374 | 3/1938 | Sedgley | 42/1 |
| 2,388,749 | 11/1945 | La Pierre | 242/132 |
| 3,243,909 | 4/1966 | Kotikov | 42/105 |
| 3,496,580 | 2/1970 | Gulmon et al. | 9/14 |
| 3,940,605 | 2/1976 | Gerber | 102/513 |
| 4,706,568 | 11/1987 | Lundwall et al. | 102/513 |
| 4,799,906 | 1/1989 | Perkins, Jr. | 441/85 |
| 5,099,747 | 3/1992 | Smith | 89/1.13 |

FOREIGN PATENT DOCUMENTS

| | | | |
|---|---|---|---|
| 8708 | 3/1919 | United Kingdom | 102/336 |
| 179495 | 5/1922 | United Kingdom | 102/504 |
| 550290 | 1/1943 | United Kingdom | 102/504 |

*Primary Examiner*—Harold J. Tudor
*Attorney, Agent, or Firm*—Richard H. Kosakowski, Esq.; Holland & Bonzagni, P.C.

[57] ABSTRACT

A line carrying projectile has an axially elongate hollow projectile rod for muzzle loading within the bore of an associated shotgun and an at least partially transparent container assembly mounted on the forward end of the projectile rod and containing a chemiluminescent flare. The flare is removed from the container and activated by bending after which it is reassembled within the container in its active condition preparatory to firing. A part of the projectile frictionally engages and grips an associated portion of the gun barrel to releasably retain the projectile in a launching position within the gun and regardless of barrel orientation until the projectile is fired from the gun.

20 Claims, 1 Drawing Sheet

LINE CARRYING PROJECTILE

BACKGROUND OF THE INVENTION

This invention relates in general to line carrying projectiles for emergency rescue operations and deals more particularly with projectiles launched from guns.

A projectile of the type with which the present invention is concerned is muzzle loaded into the bore of a firearm and propelled to a distant target by gases of explosion generated by discharging the firearm. Such a projectile is usually used to deploy a cord or relatively light line which is, in turn, used to tow a running line or towing hauser to the targeted location for use in effecting emergency rescue.

Such a line carrying projectile must be capable of effective deployment during either daylight or night rescue operations. Heretofore, such projectiles have been provided which include battery operated light signals to aid in tracking projectile trajectory and locating a projectile when it reaches a targeted area. Such battery operated devices have a relatively limited shelf life and require frequent maintenance to assure that the batteries will be in serviceable condition in time of emergency.

After a projectile has been loaded into an associated gun, the gun must be handled with its muzzle in a slightly elevated position at least until the projectile is discharged. If the muzzle end of the gun is lowered after the projectile has been loaded the projectile rod may slide out of the bore. If the projectile falls from the gun the line attached to the projectile is likely to become fouled resulting in delay until the line is cleared and the projectile reloaded. The present invention is concerned with the aforedescribed problems.

Accordingly, it is the general aim of the present invention to provide an improved gun launched line carrying projectile which provides a light signal for night rescue operations and which has a substantially longer shelf life and requires less frequent maintenance than comparable devices heretofore available. Yet another aim of the invention is to provide an improved muzzle loaded line carrying projectile for a firearm and which includes a means for releasably retaining the projectile in launching or firing position within an associated firearm regardless of the orientation of the firearm.

SUMMARY OF THE INVENTION

In accordance with the present invention an improved line carrying projectile comprises an axially elongate projectile rod sized to be slidably received within the muzzle end of the bore of an associated firearm. A container assembly secured by an associated mounting means to the forward end of the projectile rod has a hollow at least partially transparent body and contains a chemiluminescent flare. A container cap releasably secured to the container body forms a closure for an opening in the body. The projectile also includes attaching means for securing a line thereto.

DETAILED DESCRIPTION OF PREFERRED EMBODIMENT

Figure 1:
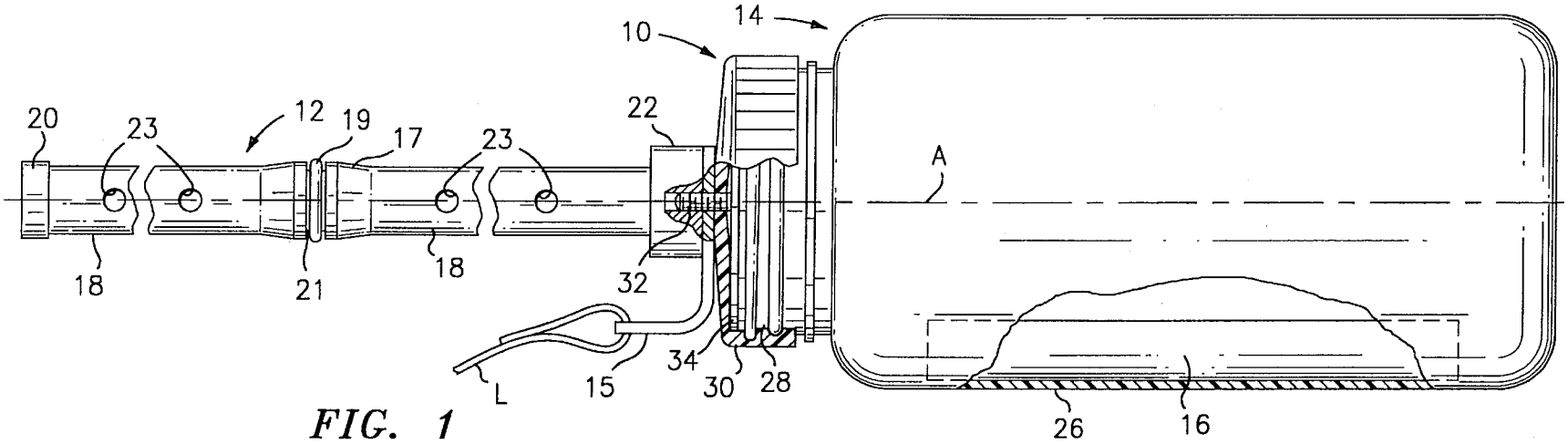
FIG. 1 is a fragmentary side elevational view of a line carrying projectile embodying the present invention, portions of the projectile shown broken away to reveal structure therebehind.

In the drawing, a line carrying projectile embodying the present invention is indicated generally by the reference numeral 10. The illustrated projectile 10 is particularly adapted to be launched from an associated firearm, such as a shotgun, to deploy a line used in an emergency rescue operation in a manner well known in the art. The projectile essentially comprises a projectile rod indicated generally at 12 and sized to be slidably received within the muzzle, end of the bore of an associated shotgun (not shown). A container assembly designated generally by the numeral 14 and mounted on the forward end of the projectile rod 12 is at least partially transparent and carries a chemiluminescent flare 16 which renders the projectile particularly suitable for use in night rescue operations. A line attaching member 15 carried by the projectile facilitates attachment of a line to the projectile, as will be hereinafter further discussed.

Considering now the projectile 10 in further detail, the projectile rod 12 includes two axially elongate hollow generally cylindrical tubular rods 18, 18 joined together in coaxial alignment by a connecting member 17 press fitted into associated ends of the rods, substantially as shown. Generally cylindrical diametrically enlarged rear and front end members or plugs, indicated at 20 and 22, respectively, are press fitted into and form closures for the opposite ends of the projectile rod 12. The rear end plug 20 is diametrically sized to be slidably received within the muzzle end of the bore of an associated shotgun (not shown). A resilient elastomeric O-ring 19 mounted within an annular groove 21 formed in the connecting member 17 coaxially surrounds the connecting member 17 and is sized to engage and frictionally grip the bore of the associated shotgun. Preferably, and as shown, a plurality of openings 23, 23 are formed in the wall of the tubular rods 18, 18 for a purpose which will be hereinafter further evident.

The container or bottle assembly 14 is mounted at the forward end of the projectile rod 12 and includes a container body 26 preferably blow molded or otherwise formed from a durable light weight resilient deformable plastic material. The container body 26 is at least partially transparent, the latter terminology being employed here and in the claims which follow to describe a material which is either wholly or partially transparent or translucent and through which light rays may readily pass. The body 26 has an externally threaded neck portion indicated at 28 which defines a conventional neck opening communicating with the interior of the container body. The container assembly 12 further includes an internally threaded generally cylindrical container cap 30 releasably threadably connected to the neck portion 28 and forming a closure for the neck opening.

The cylindrical container assembly 14 is secured to the front end plug 22 by a threaded fastener or stud 32 integrally connected to a large washer 34 received within the cap container 30. The stud 32 passes centrally through the container cap 30 to maintain the container assembly 14 in coaxial assembled alignment with the projectile rod 12, substantially as shown. A suitable sealing member (not shown) may be provided within the container cap 30 to engage the finish on the neck portion 28 to form a moisture seal for the container body 26.

The line attaching member 15 preferably comprises an L-shaped member which has one leg received on the stud 32 between the container cap 30 and the front end plug 22. The other leg of the member 15 extends rearwardly in generally parallel relation to the axis of the projectile rod 12. The line attaching member 15 is supported on the stud 32 for free rotation about the longitudinal axis of the projectile 10, the latter axis being indicated by the letter A. An aperture in the free rear end of the attaching 15 facilitates attachment of a line thereto. Such a line, indicated by the letter L, is usually fed from a canister carried by the firearms from which the projectile is launched. A typical line throwing gun fitted with such a line holder or canister is shown in U.S. Pat. No. 2,388,749 to La Pierre, assigned to Harrington and Richardson Arms Company, Worcester, Mass.

The line carrying projectile 10 hereinbefore described is particularly adapted for muzzle loading within the bore of an associated shotgun (not shown) to be propelled by gases of explosion generated by firing a blank cartridge in the gun. Consequently, the solid rear end plug 20 is sized to be slidably received within the gun bore proximate the chamber. The O-ring 19 which engages and frictionally grips the gun bore releasably secures the projectile 10 in a launching position within the gun even when the muzzle end of the gun is tipped downwardly. Thus, the O-ring 19 eliminates the risk that the projectile rod as 12 will slide out of the gun bore allowing the projectile to fall from the gun and foul the attached line L while the gun is being handled and before the projectile can be launched.

The chemical light source or chemiluminescent flare 16 contained within an carried by the container assembly 14 is useful in daylight as well as night rescue operations. Chemical lighting systems or flares of the aforedescribed general type are known in the art and produced by American Cyanamid Company, Stamford, Conn. Such flares essentially comprise chemical components which are kept separated until light is desired at which time the components are mixed to produce a chemical light reaction in the presence of a fluorescer and a catalyst. The required mixing is usually effected by bending the flare which activates it. The flare 16, stored within the container assembly 14 in its dormant or inactive condition, has a relatively long shelf life which enables the projectile 10 to be stored for a long period of time without necessity for periodic inspection and/or maintenance.

When an emergency occurs which requires deployments of a line the container assembly 14 is opened by separating the container body 26 from its threaded cap 30 in a conventional manner. The flare 16 is then removed from the container body 26 and activated by bending which causes a mixing of the chemical components to produce an immediate reaction resulting in visible light of high intensity. Upon activation, the flare 16 is dropped into the container body 26 which is secured to the projectile rod assembly by threading the body 26 onto the container cap 30. The projectile rod 12 is then inserted into the muzzle end of the bore of an associated shotgun loaded with a blank shell or cartridge. The O-ring 19 frictionally engages the gun bore to releasably retain the projectile 10 in launching position within the gun. The muzzle end of the gun barrel is then raised to a required elevation determined by the range or distance from the targeted area. When the gun is fired the gases of explosion propel the projectile toward the target. The high intensity light produced by the chemical flare permits the trajectory of the projectile to be tracked to its target even in the bright daylight.

The provision of a relatively lightweight tubular projectile rod enables a substantially lightweight container assembly 14 and lighting source 16 to be used while maintaining the center of gravity of the projectile well forward. This arrangement allows a line to be attached to the projectile near the forward end of the projectile rod, substantially as shown, thereby increasing the stability of the projectile during flight and reducing risk of tumbling.

When the projectile 10 is used in sea rescue the holes 23, 23 allow water to enter the projectile rod 12 so that the container assembly 14 may assume an axially vertical position and float in that position permitting maximum visibility of the light source enabling the projectile to be readily located in the event that it misses the target.

Figure 2:
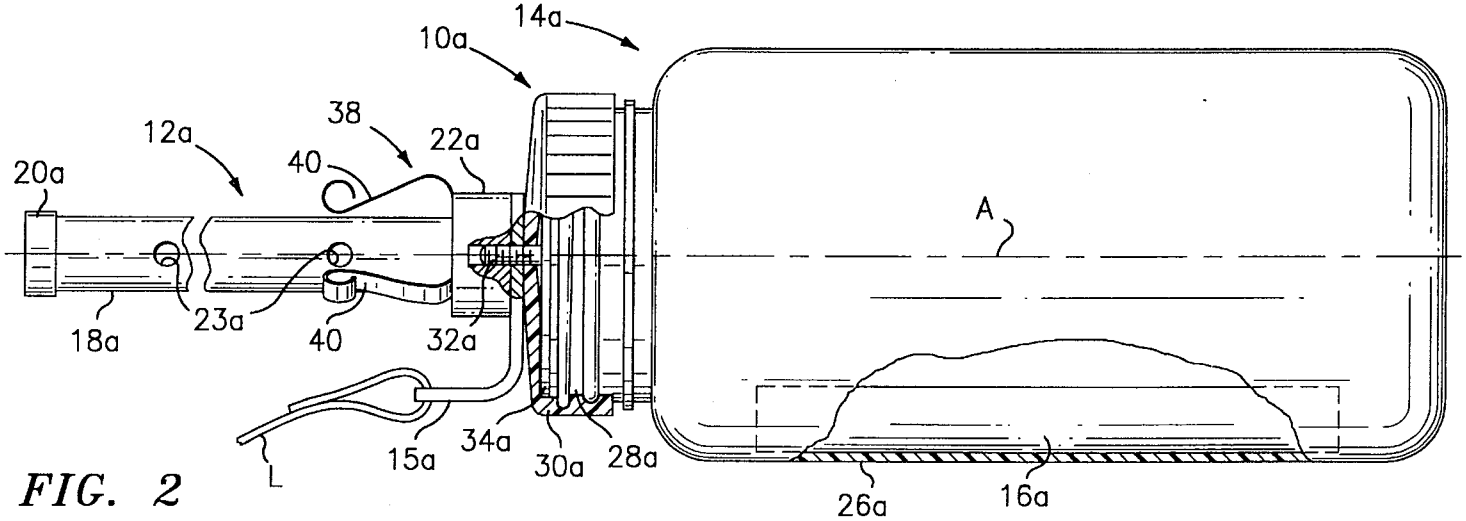
FIG. 2 is a fragmentary side elevational view similar to FIG. 1, but shows another embodiment of the invention.

Referring now to FIG. 2 another line carrying projectile embodying the present invention is indicated generally by the reference numeral **10*a*. The projectile 10*a* is similar in most respects to the previously described projectile 10** and parts which corresponds to previously described pans are identified by the same reference numerals as the previously described parts and will not be hereinafter further described.

The projectile **10*a* differs from the previously described projectile in the manner in which it is held in launching position within an associated gun bore before being fired. Specifically, the projectile rod 12 comprises a single rod 18*a* and includes a resilient retaining member or finger spring ring indicated generally at 38. The illustrated finger spring ring 38 is trapped between the forward end of the projectile rod 18*a* and the front end plug 22*a*, substantially as shown. A diametrically reduced portion of the front end plug 22*a* received within the tubular rod 18*a* passes through a complementary opening in the finger spring ring 38 so that the front end plug 22*a* retains the finger spring ring 38 adjacent the front end of the rod 18*a*. The finger spring ring includes a circumaxially spaced series of spring fingers 40, 40 which project rearwardly in the direction of the rear end plug 20*a*. The illustrated finger spring ring 38 includes three such spring fingers 40, 40 (two shown) equiangularly spaced about the axis A. The free end of each spring finger 40 is biased radially inwardly toward the projectile axis A. The resilient spring fingers 40, 40 cooperate to frictionally engage and grip the muzzle end of a shotgun barrel (not shown), when the projectile is loaded into the gun barrel, and releasably retain the projectile 10*a* in a launching position within the gun bore. After loading, the projectile 10*a*** will remain in launching position within the gun regardless of gun barrel orientation.

I claim:

1. A line carrying projectile for use with a firearm having a barrel including a muzzle end and defining a bore, said line carrying projectile comprising an axially elongate projectile rod having a forward end and a rear end and sized to be slidably received in a launching position within the bore, a container assembly including a hollow at least partially transparent container body having an opening therethrough communicating with the interior thereof and a container cap releasably secured to said container body and forming a closure for said opening, mounting means for securing said container assembly to said forward end of said projectile rod, attaching means for securing a line to said projectile and including a line attaching member supported on said mounting means forward of said projectile rod for free rotational movement about the axis of said projectile rod, a chemiluminescent flare disposed within said container assembly and retaining means carried by said projectile rearward of side line attaching means for engaging and releasably frictionally gripping the barrel of a firearm such as aforesaid to releasably secure said projectile in a launching position within the bore.

2. A line carrying projectile as set forth in claim 1 wherein said container body is made from a lightweight deformable plastic material.

3. A line carrying projectile as set forth in claim 1 wherein said container body is translucent.

4. A line carrying projectile as set forth in claim 1 wherein said mounting means comprises said container cap.

5. A line carrying means as set forth in claim 4 wherein said mounting means includes a threaded fastener extending through said container cap and threadably engaged in said projectile rod.

6. A line carrying projectile as set forth in claim 1 wherein said line attaching member comprises a generally L-shaped member having angularly spaced apart legs including one leg supported by said mounting means and another leg extending in an axial direction and toward the rear end of said projectile rod.

7. A line carrying projectile as set forth in claim 6 wherein said mounting means comprises a threaded fastener securing said container cap to said projectile rod and said one leg is supported on said fastener between said cap and said projectile rod.

8. A line carrying projectile as set forth in claim 1 wherein said retaining means comprises a retaining member mounted on said projectile at the forward end of said projectile rod and having a plurality of rearwardly extending spring fingers biased radially inwardly toward said projectile rod.

9. A line carrying projectile as set forth in claim 1 wherein said projectile rod comprises a hollow tubular member.

10. A line carrying projectile as set forth in claim 9 wherein said tubular member has plug forming closures for the forward and rear end thereof and a plurality of holes therethrough communicating with the interior thereof.

11. A line carrying projectile as set forth in claim 1 wherein said container assembly is generally cylindrical and said projectile rod is coaxially aligned with said container assembly.

12. A line carrying projectile for a firearm having a barrel including a muzzle end and a bore opening through the muzzle end, said line carrying projectile comprising, an axially elongate projectile rod sized to be slidably received in a launching position within the bore of the firearm, a container assembly mounted on one end of said projectile rod line attaching means mounted on said projectile between said container assembly and said one end of said projectile rod to rotate freely about the axis of said projectile rod for attaching a line thereto, a payload disposed within said container assembly, and retaining means mounted on said projectile rearward of said line attaching means for engaging and releasably frictionally gripping the barrel of the firearm to retain said projectile in a launching position.

13. A line carrying projectile as set forth in claim 12 wherein said retaining means comprises means for engaging and frictionally gripping the barrel of the firearm.

14. A line carrying projectile as set forth in claim 13 wherein said retaining means comprises a resilient retaining member mounted on said projectile rod and having a plurality of spring fingers for frictionally engaging and gripping the muzzle end of the barrel.

15. A line carrying projectile as set forth in claim 12 wherein said payload comprises a light source and said container is made from a material through which light may pass.

16. A line carrying projectile as set forth in claim 15 wherein said light source comprises a chemiluminescent flare.

17. A line carrying projectile for use with a firearm having a barrel including a muzzle and a bore opening through the muzzle, said line carrying projectile comprising an axially elongate generally cylindrical tubular projectile rod, front and rear end plugs secured to and forming closures for the front and rear ends of said projectile rod, said rear end plug being diametrically enlarged and sized to be slidably received in a launching position within the bore, a container assembly including a resilient deformable container body made from at least partially transparent plastic material and having an opening therein communicating with the interior of said body and a cap releasably secured to said body, fastening means for securing said cap to said front plug, a chemiluminescent flare disposed within said container body, line attaching means supported by said fastening means to rotate freely about the axis of said projectile rod between said front end plug and said container cap for attaching a line thereto, and retaining means carried by said projectile for engaging and releasably frictionally gripping the barrel of a firearm such as aforesaid to releasably secure said projectile in a launching position within the bore.

18. A line carrying projectile as set forth in claim 17 wherein said retaining means comprises means for frictionally engaging the bore of the firearm.

19. A line carrying projectile as set forth in claim 18 wherein said retaining means comprises a resilient O-ring encircling said projectile rod in axially spaced relation to the rear end of said projectile rod.

20. A line carrying projectile as set forth in claim 19 wherein said O-ring is disposed within an annular groove in said projectile rod.

* * * * *